United States Patent [19]

Butler

[11] 4,202,374

[45] May 13, 1980

[54] FLUID SWITCH WITH REFLECTED SHOCK WAVE

[75] Inventor: Denis V. Butler, Fareham, England

[73] Assignee: Plessey Handel und Investments AG, Zug, Switzerland

[21] Appl. No.: 880,867

[22] Filed: Feb. 24, 1978

[30] Foreign Application Priority Data

Mar. 2, 1977 [GB] United Kingdom ..... 8858/77

[51] Int. Cl.[2] ..... F15C 1/04

[52] U.S. Cl. ..... 137/827; 137/828

[58] Field of Search ..... 137/827, 828

[56] References Cited

U.S. PATENT DOCUMENTS

| | | | |
|---|---|---|---|
| 3,168,897 | 2/1965 | Adams et al. | 137/827 X |
| 3,263,695 | 8/1966 | Scudder et al. | 137/827 |
| 3,428,066 | 2/1969 | Herr | 137/827 |
| 3,591,809 | 7/1971 | Laakaniemi | 137/827 X |

*Primary Examiner*—William R. Cline

*Attorney, Agent, or Firm*—Fleit & Jacobson

[57] ABSTRACT

A switch arrangement in which shock wave energy is utilized to switch the path of a fluid through a fluidic device, the switch arrangement being such that a reflector is employed to direct the shock wave to a desired position in the switch arrangement.

2 Claims, 2 Drawing Figures

FLUID SWITCH WITH REFLECTED SHOCK WAVE

BACKGROUND OF THE INVENTION

This invention relates to a switch arrangement. More specifically, this invention relates to a switch arrangement for switching the path of a fluid through a fluidic device.

It is known to switch a fluidic device by employing the shockwave associated with an electrical discharge, i.e. a spark. The known devices rely solely on that zone of the spherical shockwave subtended by the area of interaction to the centre of propagation. In practice, this means that the propagating device must either be close to the area of interaction or excessively powerful.

SUMMARY OF THE INVENTION

It is an aim of the present invention to overcome the above mentioned disadvantage of the known devices.

Accordingly, the present invention provides a switch arrangement in which shockwave energy is utilised to switch the path of a fluid through a fluidic device, the switch arrangement being such that a reflector is employed to direct the shockwave to a desired position in the switch arrangement.

The reflector may be a parabolic or a circular arc reflector. The reflector may be essentially two dimensional or it may be a section of revolution, i.e. extending in all directions.

Usually, the reflector will be placed directly behind the discharge source and it will be focussed on the area of interaction of the fluid jets in the switch arrangement. The discharge source can thus be placed at a convenient point remote from the area of interaction, e.g. at a point where it does not interfere with the geometric requirements of the fluidic device.

The switch arrangement of the invention may thus provide an efficient and simple means of operating a non-moving part interface between an electronic signal generating or receiving device and a fluidic device or system. The use of the reflector enables less power to be used than in the known devices.

The switch arrangement of the invention may be used to provide an electronic input to a fluidic system as an alternative to a fully fluidic system. The switch arrangement can clearly be used in any appropriate system requiring a switching facility.

Two embodiments of the invention will now be described solely by way of example and with reference to the accompanying drawings in which:

DESCRIPTION OF THE PREFERRED EMBODIMENTS

Figure 1:
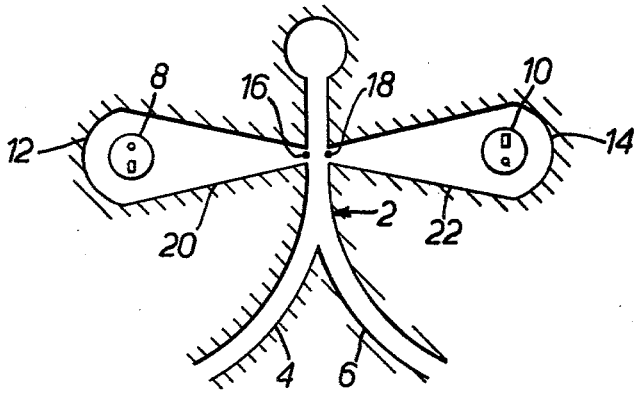
FIG. 1 is a schematic plan view of a first switch arrangement in accordance with the invention and, FIG. 2 is a schematic plan view of a second switch arrangement in accordance with the invention.

Referring to FIG. 1, there is shown a bistable fluidic element 2 having fluid paths 4,6. The fluid can be switched between these paths 4,6 by means of the spark propagators 8,10 and their associated two dimensional parabolic reflectors 12,14. The reflectors 12,14 are focussed on the areas of interaction 16,18.

Figure 2:
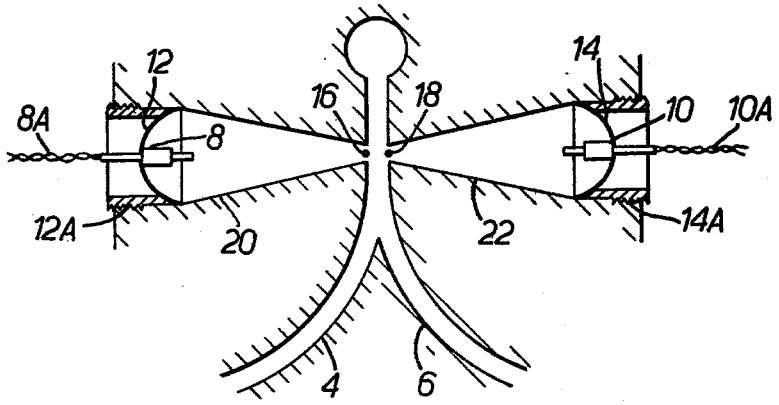

Referring now to FIG. 2, similar parts have been given the same reference numeral. In FIG. 2, the spark propagators 8,10 have been shown in more detail with attached leads 8A, 10A. Also, the reflectors 12,14 in FIG. 2 are full parabolic reflectors and they communicate with the areas of propagation 16,18 by conic sections 20,22 instead of by tapered flat sections 20,22 as in FIG. 1. Screw threaded members 12A, 14A are provided for screwing the reflectors 12,14 in and out to facilitate correct focussing of the reflectors.

The use of the reflectors 12,14 enables less power to be used to switch the fluidic element 2 than would be required if the reflectors were not employed. Also, as indicated above, the reflectors 12,14 can be placed at a convenient point that does not interfere with the geometric requirements of the fluidic device.

The number of reflectors and the number of spark propagators employed depends upon the number of fluid paths to be switched. Also, if desired, more than one reflector and spark propagator, e.g. plug, could be employed for each fluid path.

It is to be appreciated that the embodiments of the invention described above have been given by way of example only and that modifications may be effected.

What we claim is:

1. A fluid switch device in which shockwave energy is utilized to switch the path of a fluid comprising, a fluid input channel means for guiding fluid flow from a fluid source; a first fluid output channel means connected with said fluid input channel means for guiding fluid flow from said fluid input channel means; a second fluid output channel means connected with said fluid input channel means for guiding fluid flow from said fluid input channel means; switching means for selectively directing fluid flow from said fluid input channel means to one of said first and second fluid output channel means, said switching means comprising, a reflector means for reflecting a shockwave, said reflector means comprising a conical surface of revolution having a parabolic base, said surface of revolution defining an opening at its apex, said opening in fluid communication with said fluid input channel means upstream of said first and second fluid output channel means; and means for propagating a shockwave comprising an electrical discharge source, said electrical discharge source positioned in said conical surface of revolution between said parabolic base and said opening, wherein said shockwave is reflectable by said reflector means toward said opening.

2. A fluid switch device as claimed in claim 1 wherein said reflector means further comprises means for moving said parabolic base in a direction toward and away from said opening.

* * * * *